US006769203B1

(12) United States Patent
Wright et al.

(10) Patent No.: US 6,769,203 B1
(45) Date of Patent: Aug. 3, 2004

(54) SKATE BOOT

(75) Inventors: Steve Wright, Beaverton, OR (US); Carl Madore, Beaverton, OR (US)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/560,789

(22) Filed: Apr. 28, 2000

(51) Int. Cl.[7] ..... A43B 5/04; A43B 5/16; A43B 23/00

(52) U.S. Cl. ..... 36/115; 36/117.1; 36/119.1; 36/45; 36/46.5

(58) Field of Search ..... 36/115, 116, 119.1, 36/117.1, 117.3, 45, 46.5, 47, 48, 49, 54

(56) References Cited

U.S. PATENT DOCUMENTS

| | | | | | |
|---|---|---|---|---|---|
| 3,076,274 | A | * | 2/1963 | Schlecht | 36/115 |
| 3,190,015 | A | * | 6/1965 | Binder et al. | 36/115 |
| 4,194,308 | A | * | 3/1980 | Karlsson | 36/48 |
| 4,385,456 | A | * | 5/1983 | Livernois et al. | 36/115 |
| 4,433,494 | A | * | 2/1984 | Courvoisier et al. | 36/119.1 |
| 4,835,885 | A | * | 6/1989 | Hoshizaki et al. | 36/115 |
| 5,174,050 | A | * | 12/1992 | Gabrielli | 36/117.1 |
| 5,289,645 | A | * | 3/1994 | Marega et al. | 36/54 |
| 5,339,544 | A | * | 8/1994 | Caberlotto | 36/102 |
| 5,342,070 | A | * | 8/1994 | Miller et al. | 36/115 |
| 5,778,566 | A | * | 7/1998 | Edauw et al. | 36/117.1 |
| 5,885,500 | A | | 3/1999 | Tawney et al. | |
| 6,048,810 | A | * | 4/2000 | Baychar | 36/117.3 |
| 6,079,128 | A | * | 6/2000 | Hoshizaki et al. | 36/115 |
| 6,102,412 | A | * | 8/2000 | Staffaroni | 36/115 |
| 6,260,290 | B1 | * | 7/2001 | Chenevert | 36/115 |
| 6,295,679 | B1 | * | 10/2001 | Chenevert | 36/115 |
| 6,305,101 | B2 | * | 10/2001 | Chemello | 36/72 R |

FOREIGN PATENT DOCUMENTS

| | | |
|---|---|---|
| CA | 1132793 | 10/1982 |
| CA | 1189697 | 7/1985 |
| CA | 2000090 | 4/1990 |

* cited by examiner

*Primary Examiner*—Anthony D. Stashick
(74) *Attorney, Agent, or Firm*—RatnerPrestia

(57) ABSTRACT

A skate boot for ice skate or in-line roller skate comprising an upper having portions thereof made of compressed foam material. In a preferred embodiment, the skate boot is constructed with two preformed quarter panels made of compressed foam material having wherein the inner surface of each panel is shaped to substantially conform to the anatomical shape of a corresponding side of the human foot. Such a construction provides a skate boot, which is comfortable, long lasting, and exhibits flexibility and support. Such a construction also provides added flexibility to the skate designers to vary the dynamic properties of the skate and also the ornamental features of the skate. A method of making such a skate boot is also disclosed.

42 Claims, 10 Drawing Sheets

SKATE BOOT

FIELD OF THE INVENTION

The invention relates to a skate boot such as used for ice skates or in-line roller skates and more particularly to a skate boot construction.

BACKGROUND OF THE INVENTION

Typical skate boots are fabricated by assembling together previously die-cut pieces of textile material and shaping them over a last. Various pieces of textiles or fabrics are cut to specific patterns, which are then pre-assembled by stitching or gluing or both into a multi-layer construction. The rigidity and flexibility characteristics of the skate boot are defined by the various layers of materials being positioned and layered in specific regions of the pre-assembled component of the skate boot. The accumulation of pieces of material into layers and the mechanical properties of each piece of textile or fabric material define the overall dynamic behavior of the skate boot. Usually, the pre-assembled component further includes rigid components generally made of plastic to increase the rigidity of specific area of the skate boot. The pre-assembled boot generally consists of the back and sides of the skate boot and a toe cap and tongue assembly. The pre-assembled boot has the general configuration of the finished product but has not yet been shaped to the final form of the skate boot.

The pre-assembled component is positioned over a last and formed to obtain the shape of the desired finished product. A last is a three-dimensional shape of the inside cavity of a boot. The pre-assembled boot may be mounted upside down onto the last for ease of manipulation and assembly of the remaining components making up the skate boot. An insole is placed on the top part of the upside down last and the pre-assembled boot is stretched over the last and over the insole in order for the pre-assembled boot to conform to the specific shape of the last. The stretched material is then glued and nailed or tacked to the insole to maintain the desired shape. Once the upper part of the skate boot is completed, a rigid outsole is glued to the insole of the boot to complete the skate boot. An ice blade holder or an in-line roller chassis is finally mounted to the bottom of the boot to complete the skate.

This type of process is extensively used in the shoemaking industry. It generates a good product but has some disadvantages. For instance, the number of parts involved in the multilayer construction can be staggering; a conventional ice skate for hockey may have up to eighty parts to be assembled and shaped over the last. As a consequence, the manufacturing process is lengthy and complex. The nature of the assembly of parts is inherently labor intensive and slow as there are many manual tasks to be performed and many steps are necessary to complete the footwear. The considerable number of elements to be assembled entails an increased risk of errors, particularly in the alignment of the various pieces of the pre-assembled boot, which contributes to an increase in the number of rejected boots or skates in the manufacturing process or at least, a reduction in the quality of the overall production. This traditional process of making skate boot also requires several molds and cutting dies to produce all the pieces necessary for making the pre-assembled boot.

In an effort to reduce the number of components used to make a skate boot, these are sometimes made of an exterior plastic molded shell. However, skate boots made of molded plastic tend to be stiff and/or cumbersome, do not perform as well as traditionally made skate boots and for that reason, have not found wide acceptance amongst professional hockey players. U.S. Pat. No. 4,509,276 to Bourque discloses a skate boot made of a combination of plastic and fabric material. The skate boot disclosed consists of a lower exterior molded rigid plastic portion and intermediate and upper portions made of pliable material to allow forward flexure and torsional flexibility in the ankle area.

These designs effectively reduce the number of components utilized in the manufacturing process of a footwear or skate. However, the end product is usually stiffer than a traditionally made skate boot and represents a compromise in the area of performance.

Thus there is a need in the industry for a skate boot made of fewer components than the traditionally made skate boot yet provides a skate boot that performs as well as a traditionally made skate boot.

Furthermore, skates using typical skate boots made of conventional textile or fabric materials using the conventional lasting method perform well for some time but have a tendency to develop creases around the ankle area and deteriorate over time. The material used in the making of a typical skate boot deteriorates with time and eventually fails to provide the adequate support necessary for optimal skating performance. Conversely, skates having skate boots made of molded rigid plastic may not wear out as quickly as skates using typical skate boots but they do not provide the flexibility of a typical skate boot.

Thus there is also a need for a skate, which provides flexibility and durability as well as optimal performance.

OBJECTS AND STATEMENT OF THE INVENTION

It is thus an object of the invention to provide a skate boot made of fewer components than a traditionally made skate boot.

It is another object of the invention to provide a skate boot having elastic dynamic behavior.

It is another object of the invention to provide a skate which provides flexibility and durability.

It is another object of the invention to provide a skate boot construction which is less labor intensive and more cost effective to build than a traditionally made skate boot.

It is another object of the invention to provide a method of making a skate boot, which is more cost effective than the traditional method.

As embodied and broadly described herein, the invention provides a skate boot having an upper for enclosing and supporting a human foot. The upper comprises:

- a heel counter for surrounding the sides and back of the heel portion of a human foot;
- an ankle support for surrounding and supporting the ankle region of a human foot:
- a medial quarter and a lateral quarter for enclosing each side of a human foot, each quarter having a frontal edge, the medial and lateral quarters extending forwardly from the heel counter and the ankle support. The quarters define respective medial and lateral side of said skate boot;
- bridging means for joining said quarters together at the heel counter and the ankle support;
- an insole forming the bottom of the upper;
- a toe box for covering the toe area of the human foot, which is connected to the frontal edges of the lateral and medial quarters;

a tongue extending upwardly and rearwardly from the toe box for covering the upper frontal part of the human foot and ankle; and a rigid outsole defining the under side of the skate boot;

wherein at least one of the lateral and medial quarters consists of a preformed molded panel made of foam material having an inner surface and an outer surface wherein the inner surface of the panel is shaped to substantially conform to the anatomical shape of a corresponding side of the human foot.

Preferably, each said lateral quarter and medial quarter consists of a preformed molded panel made of foam material having an inner surface and an outer surface wherein the inner surface of said panel is shaped to substantially conform to the anatomical shape of a corresponding side of the human foot.

Advantageously, the outer surface of the preformed molded panel comprises a protective textile overlay made of synthetic material resistive to abrasion and cutting.

As embodied and broadly described herein, the invention further provides a skate boot having an upper for supporting and enclosing a human foot, the upper comprising:

a heel counter for surrounding the sides and back of the heel portion of a human foot;

an ankle support for surrounding and supporting the ankle region of a human foot;

a medial quarter and a lateral quarter for enclosing each side of a human foot, each quarter having a frontal edge, the medial and lateral quarters extending forwardly from the heel counter and the ankle support. The quarters defining respective medial and lateral side of the skate boot;

an insole forming the bottom of the upper;

a toe box for covering the toe area of the human foot, which is connected to the frontal edges of the lateral and medial quarters;

a tongue extending upwardly and rearwardly from the toe box for covering the upper frontal part of the human foot and ankle; and a rigid outsole defining the under side of said skate boot;

wherein at least a substantial portion of the upper comprises a preformed molded element made of thermoformable foam material shaped to a definitive shape.

As embodied and broadly described herein, the invention further provides a method of making a skate boot comprising the steps of:

(a) forming a foam quarter panel by molding a sheet of foam material;

(b) assembling to said foam quarter panel, a rear cover, an inner lining, an insole, a toe box and a tongue to form a skate boot upper; and (c) affixing an outer sole to the under side of said skate boot upper.

In a preferred embodiment of the method, two foam quarter panels are formed by molding sheets of foam material, one medial foam quarter panel and one lateral foam quarter panel, said foam quarter panels being assembled together at the rear prior to the step of assembling to said foam quarter panels, a rear cover, an inner lining, an insole, a toe box and a tongue to form a skate boot upper. The skate boot upper preferably includes a lower skirt wherein the preferred embodiment of the method further comprising the steps of:

(i) positioning said skate boot upper over a last;

(ii) shaping over the last said skate boot upper by folding said lower skirt of said upper underneath said insole and fastening said skirt to said insole; prior to affixing an outer sole to the under side of said skate boot upper.

Preferably, the step of forming a foam quarter panel by molding a sheet of foam material comprises the steps of:

(a) positioning the sheet of foam material into a male-female mold and closing the mold;

(b) applying heat and pressure to the sheet of foam material;

(c) thermoforming at least a portion of the sheet of foam material to the shape of the male-female mold;

(d) cooling the portion of the sheet of foam material in a compressed state so that the portion of the sheet of foam material sets in the shape of the male-female mold; and (e) opening the male-female mold and removing the molded foam quarter panel from the mold.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

Figure 1:
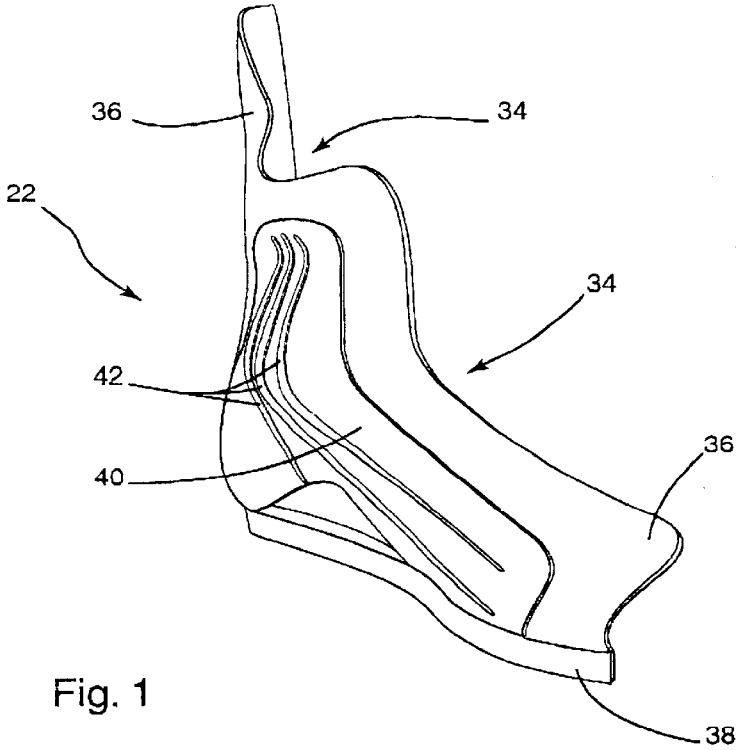
FIG. 1 is a perspective view illustrating a preformed molded quarter panel for a skate boot according to an embodiment of the invention.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

Figure 13:
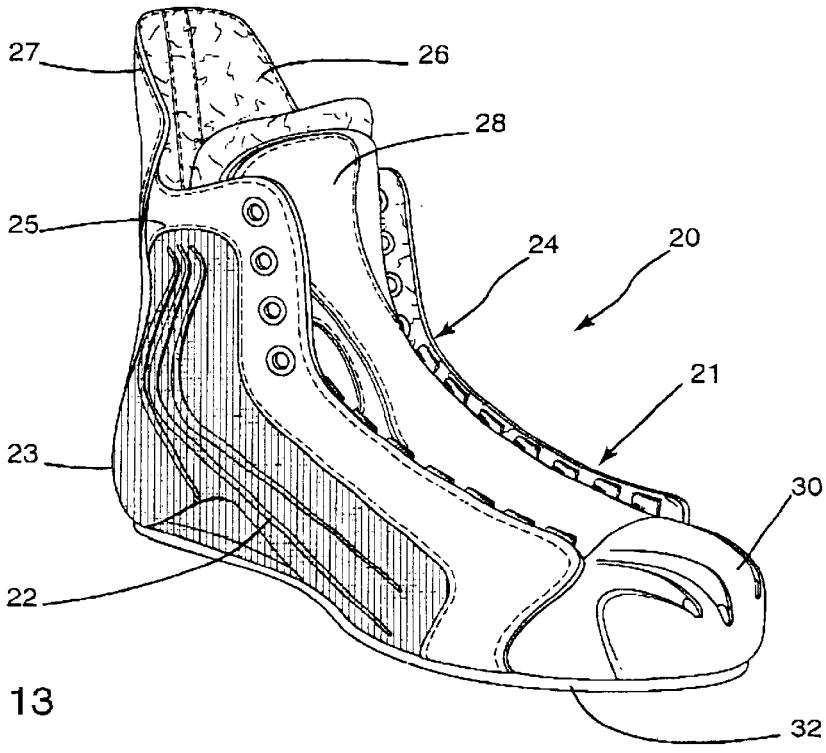
FIG. 13 is a perspective view illustrating the completed upper according to an embodiment of the invention.

A skate boot manufactured in accordance with the present invention is illustrated generally by reference numeral 20 in FIG. 13. Skate boot 20 preferably includes an upper 21 having a heel counter 23 which cups around the wearer's heel, an ankle support 25 enclosing a substantial portion of the wearer's ankle, a lateral preformed molded quarter panel 22 and a medial preformed molded quarter panel 24 extending along each side of the wearer's foot and ankle, and a tendon guard 27 secured to the upper edge of ankle support 25 or made integral therewith. Skate boot 20 further includes an inner lining 26 which is a layer of soft material covering the inside walls of skate boot 20 or at least a portion thereof. Skate boot 20 also includes a cushioning tongue 28 and a toe box 30. Skate boot 20 is completed with an outsole 32 covering the bottom portion of upper 21. In accordance with one embodiment of the invention, preformed molded quarter panels 22 and 24 are molded from a foam material prior to assembly into upper 21. Outsole 32 is molded from a rigid plastic and mounted to the bottom surface of upper 21 with adhesive or nails, preferably both.

Figure 2:
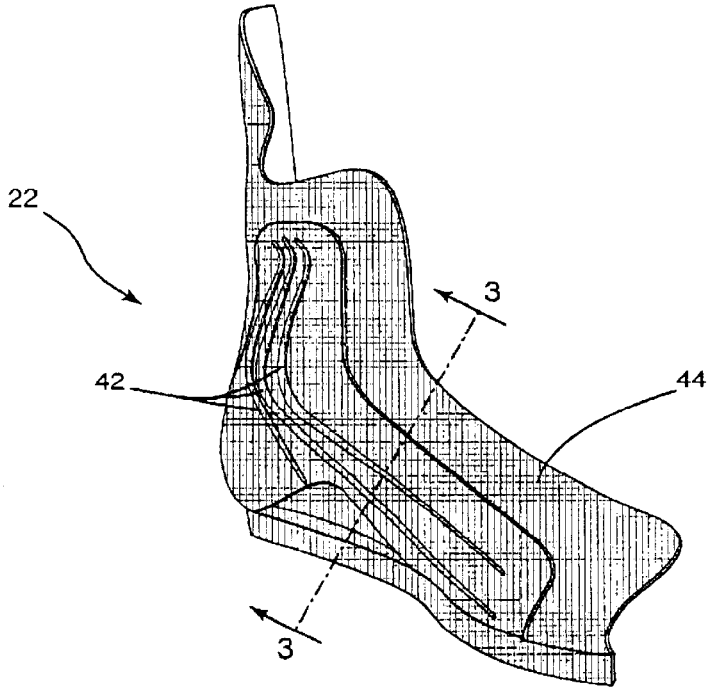
FIG. 2 is a perspective view illustrating the preformed molded quarter panel of FIG. 1 with an added protective overlay according to an embodiment of the invention.
Figure 3:
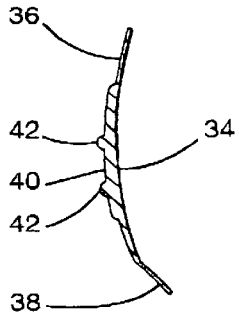
FIG. 3 is a cross-sectional view of the preformed molded quarter panel taken at line 3—3 of FIG. 2 according to an embodiment of the invention.

FIGS. 1—3 illustrates an exemplary embodiment of a lateral preformed molded quarter panel 22; a medial preformed molded quarter panel 24 being constructed in a similar fashion although not being an exact mirror image of lateral preformed molded quarter panel 22. The two panels 22 and 24 are shaped to conform to the exterior and interior contour of the foot. As shown in FIGS. 1 to 3, lateral foam quarter panel 22 is a preformed three-dimensional one-piece component. It comprises a peripheral thin region 36, which makes up the periphery of upper 21 as well as the rear and tendon guard area of upper 21. Lateral foam quarter panel 22 also comprises a flexible skirt 38 located on its lower edge, and a central portion 40 having variations of thickness. Central portion 40 being thicker than the rest of quarter panel 22 is not as easily bent as the peripheral region and as such provides rigidity and structure to skate boot 20. In this embodiment, central portion 40 further comprises an array of ribs 42, which may serve to increase the rigidity of quarter panel 22 by adding more thickness locally. Ribs 42 may also serve simply as decorative elements.

The interior surface 34 of lateral foam quarter panel 22 has approximately the same shape and configuration of a human foot. Once assembled, it defines the interior shape of skate boot 20. The interior surface 34 of preformed quarter panels 22 and 24 is taken from a three dimensional model of the foot and ankle morphology of a typical human foot which accounts for statistical variations of the relative position of the lateral and medial malleolus within a specific size range. As shown in FIG. 3, which is a cross-sectional view of preformed quarter panel 22 taken at line 3—3, the interior surface 34 is smooth and is adapted to conform to the general morphology of a human foot in order to provide a comfortable contacting surface between skate boot 20 and the foot.

Figure 5:
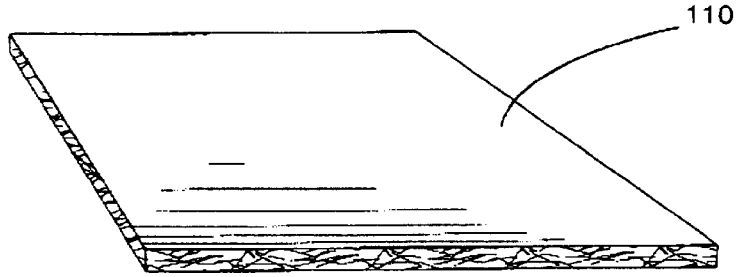
FIG. 5 is a perspective view illustrating a sheet of foam material.

The molded foam quarter panels are manufactured one-piece components produced by thermo-pressured molding of a suitable thermosetting foam material initially in uniform thickness sheet form such as a precut sheet of EVA (Ethylene Vinyl Acetate) foam 110 as shown in FIG. 5, preferably Phylon®, having a uniform thickness, and precutting sheet 110 to a desired contour. The one-piece components may also be made of polyolefin foam or polyurethane foam. A nonuniform thickness sheet of EVA foam 110 may also be used to obtain various mechanical properties of the foam quarter panels. As illustrated in FIG. 2, a protective textile overlay 44 is laminated onto the outer surface of the foam quarter panels preferably prior to the quarter panel being molded or after the foam quarter panels has been molded. The protective overlay 44 is a synthetic material, which is resistive to abrasion and cutting. A preferred material is nylon.

Figure 4:
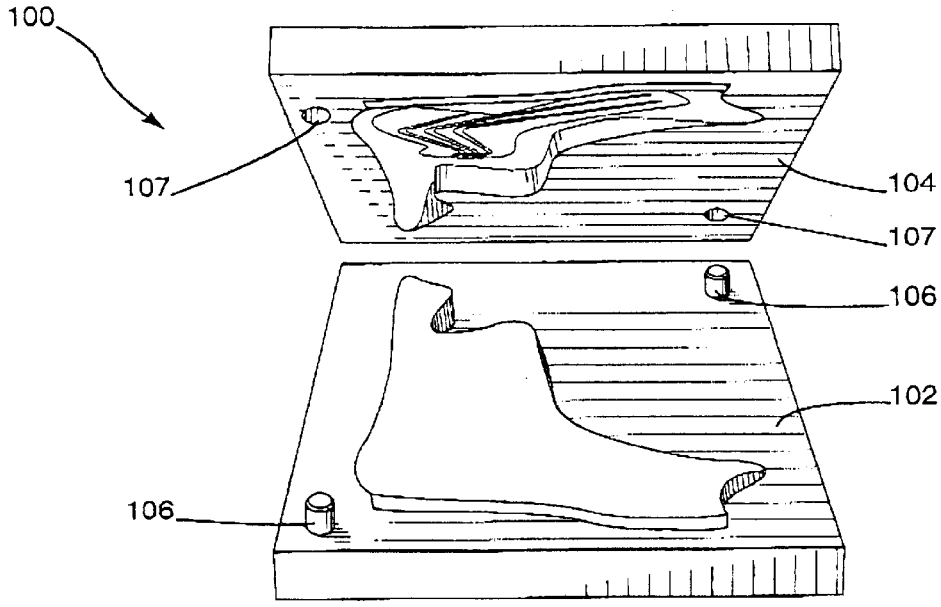
FIG. 4 is a perspective view illustrating a mold for forming the quarter panels according to an embodiment of the invention.

The pre-cut sheet of EVA foam with its protective overlay 44 is then inserted into the cavity of a male-female mold 100 as shown in FIG. 4. The male portion 102 of mold 100 defines the interior surface 34 of the foam quarter panels whereas the female portion 104 of mold 100 defines its exterior surface. As illustrated, male portion 102, which defines the interior surface 34, is smooth and is shaped to generally conform to the morphology of a typical foot and ankle. Female portion 104 defines the outer surface of the foam quarter panels and as such can have numerous variations of designs to vary the mechanical properties of the foam quarter panels and to incorporate decorative features.

The precut foam sheet 110 is aligned and temporarily secured to one of the mold portions 102 or 104 using any suitable means to accurately position precut foam sheet 110 within mold 100 and maintain sheet 110 in position when mold 100 is closed. Once mold 100 is closed over precut foam sheet 110, mold 100 is heated up to the thermoforming temperature of the foam and male and female portions 102 and 104 are pressed against the foam sheet 110. In a preferred embodiment of the invention, heat and pressure are applied simultaneously for a period of 8 to 10 minutes after which mold 100 is allowed to cool down so that the foam sheet 110 will set to the three-dimensional shape defined by the cavity of mold 100. When heat and pressure are applied to foam sheet 110, the foam material originally in the thin area of the quarter panel tends to migrate to the thicker area of the quarter panel, thereby marginally increasing the density of the foam in the thicker area. Prior to removing the foam quarter panel from mold 100, mold 100 is cooled down for a period of time which is tong enough for foam quarter panel to set and retain its new shape once removed. Upon removal, excess material of the initial foam sheet 110 remaining along the edges of the molded article is trimmed off as required to define the foam quarter panel as illustrated in FIGS. 1 and 2.

In the molding process described above, the applied heat is generally between 250° F. and 350° F., with the preferred temperature being approximately 300° F. The applied pressure is generally between 50 psi and 150 psi, with the preferred pressure being approximately 100 psi. The heat and pressure are applied for approximately 10 minutes and then the heat is turned off while maintaining minimal pressure to allow cooling of mold 100 so that the foam quarter panel will set in its new three-dimensional shape.

Skate boot 20 is designed to have stiffness variations in localized regions of upper 21. As described, the variation of stiffness of skate boot 20 is obtained at least partially by the use of preformed molded foam quarter panels. By utilizing different grades of foam material, different foam materials, the same foam material with different density, or the same foam material with different quantities in localized regions, the designers are able to vary, within a certain range, the mechanical properties of the molded quarter panels. The variation of stiffness or mechanical properties of the molded quarter panels directly affects the dynamic behavior of skate boot 20. As a further benefit of the molded foam panels, decorative or ornamental features such as ribs 42 may easily be added to the design providing more artistic flexibility to the designers.

Figure 6:
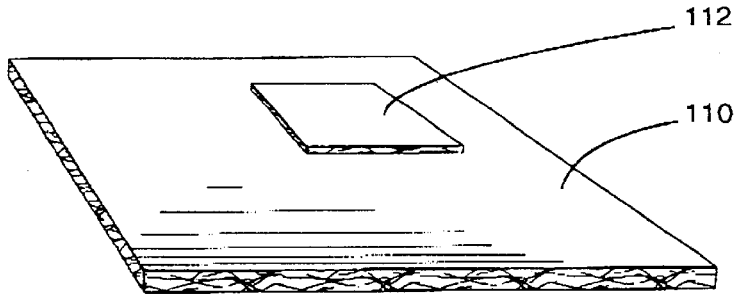
FIG. 6 is a perspective view illustrating a sheet of foam material with an additional foam element.

Referring to FIG. 6, as a variant of the present invention, the mechanical properties of the foam quarter panels may be locally modified by positioning additional layers of foam sheets 112 of different densities in strategic areas and then heating and compressing as described above. There are several options for varying the mechanical properties of the foam quarter panels to meet particular conditions. For instance, sheet 110 may also be provided with thinner portions to provide localized changes in the stiffness of the molded foam quarter panels. A thinner portion of foam material provides a softer area for greater flexibility.

Figure 7:
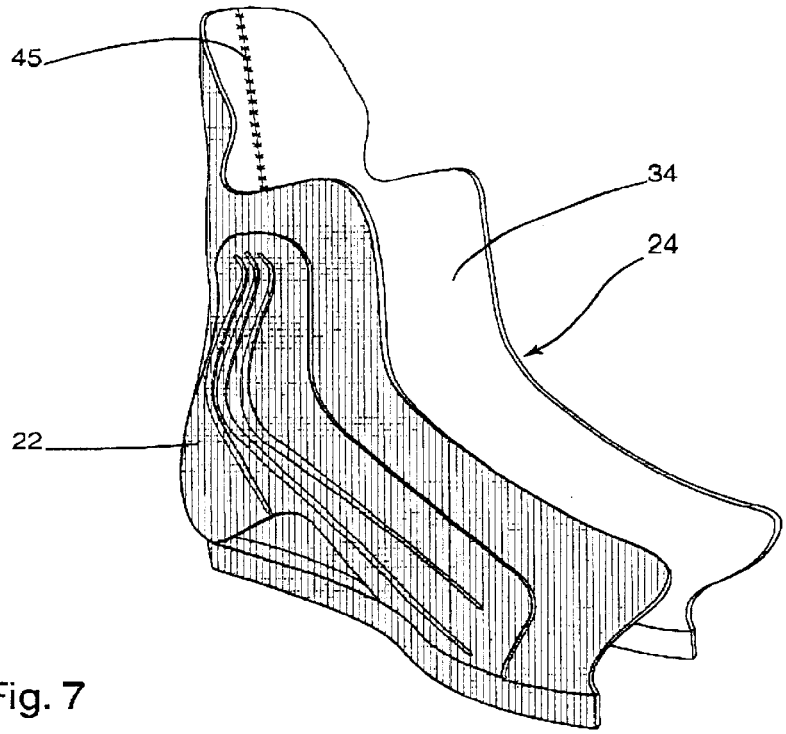
FIG. 7 is a perspective view illustrating the lateral and medial preformed molded quarter panels assembled together according to an embodiment of the invention.
Figure 8:
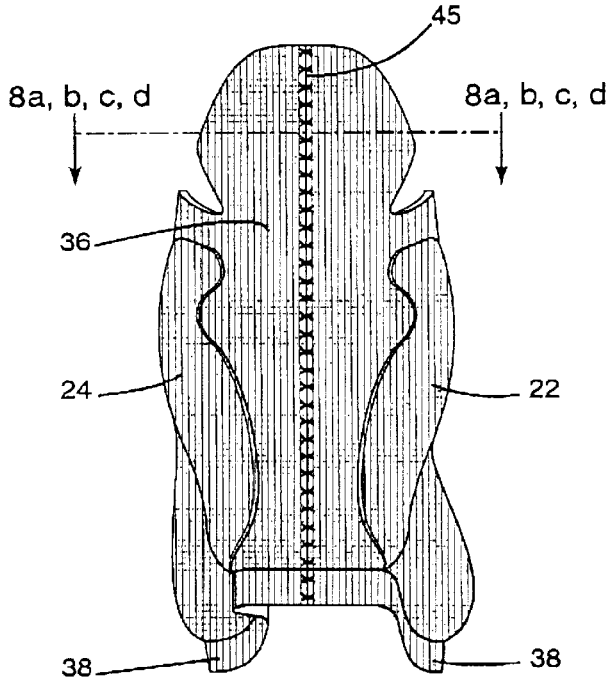
FIG. 8 is a rear elevational view of the assembled lateral and medial preformed molded quarter panels according to an embodiment of the invention.
Figure 8A:
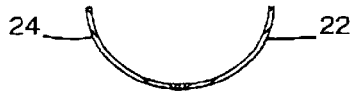
FIG. 8*a* is a cross-sectional.view of the preformed molded quarter panel taken at line 8*a*—8*a* of FIG. 8 according to an embodiment of the invention.
Figure 8B:
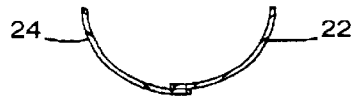
FIG. 8*b* is a cross-sectional view of the preformed molded quarter panel taken at line 8*b*—8*b* of FIG. 8 according to an embodiment of the invention.
Figure 8C:
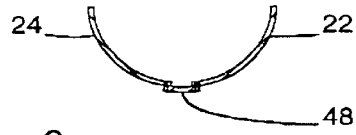
FIG. 8*c* is a cross-sectional view of the preformed molded quarter panel taken at line 8*c*—8*c* of FIG. 8 according to an embodiment of the invention.

Referring to FIGS. 7 and 8, the first structural elements of upper 21 consists of lateral and medial preformed foam quarter panels 22 and 24. Upper 21 is constructed by first combining quarter panels 22 and 24 together along a vertical line 45. Quarter panels 22 and 24 are preferably bridged together by means of zigzag, crossed stitching or any other suitable bridging means. As illustrated in FIGS. 8*a, b* and *c*, quarter panels 22 and 24 may be either abutting together as shown in FIG. 8*a,* overlapping each other as shown in FIG. 8*b,* or joined together by a rear link 48 which is either sewn or glued to each quarter panels 22 and 24 as shown in FIG. 8*c.*

Figure 8D:
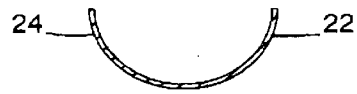
FIG. 8*d* is a cross-sectional view of the preformed molded quarter panel taken at line 8*d*—8*d* of FIG. 8 according to an embodiment of the invention.

As illustrated in FIG. 8*d,* lateral and medial preformed foam quarter panels 22 and 24 may also. be molded into a one-piece component thereby avoiding the combining step of the construction of upper 21 so that the bridging means is integral with each quarter panels. A larger male-female mold consisting of two side by side cavities similar to mold 100 laid flat and linked together at the thin region 36 forming the rear portion of skate boot 20 may be used. The preformed molded panels removed from the mold are simply bent to shape at the thin region 36 forming the rear portion of skate boot 20. The dual cavity mold may also be also be angled inwardly such that minimal bending of the preformed molded panels is required to obtain the desired shape panels. Although more complex, a dual cavity mold as described further reduces the number of steps required to produce upper 21.

Figure 9:
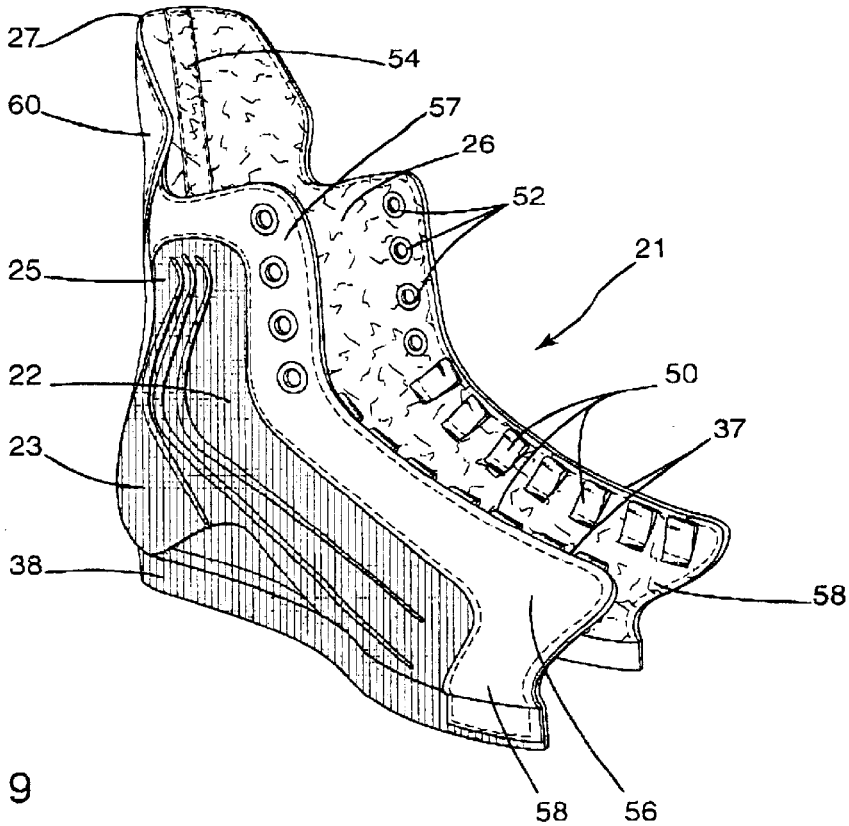
FIG. 9 is a perspective view illustrating the preformed quarters of the upper with an inner lining installed, lace eyelets and loops, and various external pieces added according to an embodiment of the invention.
Figure 10:
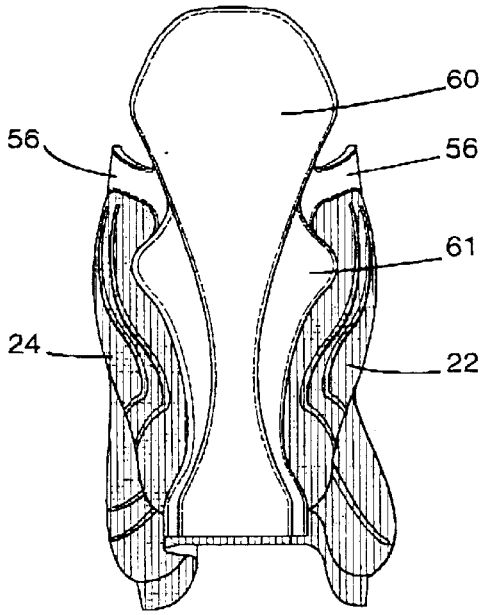
FIG. 10 is a rear elevational view of the upper of FIG. 9.

Referring now to FIGS. 9 and 10, once quarter panels 22 and 24 are combined and define the main structural component of upper 21, a first external layer of material in the form of a narrow band 56 is sewn along a substantial portion of the periphery of quarter panels 22 and 24. Narrow band 56 extend from the front lower edge 58 of each quarter panel, along upper edge 37, up along the frontal portion 57 of ankle support 25 and around to the rear portion of ankle support 25. Narrow band 56 may be a continuous one piece-component integrally connected at the rear of ankle support 25 or it may be two separate bands 56. Narrow band 56 covers a substantial portion of peripheral thin region 36 of each quarter panel 22 and 24 and encircles the upper edge of the thicker more structural central portion 40 of each quarter panel 22 and 24.

A second layer of material in the form of a rear cover 60 is sewn or otherwise attached to the rear portion of upper 21. Rear cover 60 extends from the top of tendon guard 27 down to the bottom of heel counter 23 and covers any joining lines such as vertical line 45 (FIG. 8) that may be visible at the back of upper 21. Rear cover 60 also reinforces the rear portion of upper 21. A second rear cover 61 may be added to increase support or for ornamental purposes.

Subsequently, an inner lining 26 is preferably glued to the interior surface 34 or to at least the upper portion of the interior surface 34 covering the ankle support area 25. Inner lining 26 may also be glued to the interior surfaces of each foam quarter panel 22 and 24 prior to their assembly. An added strip of lining 54 is stitched over the separation line resulting therefrom when quarter panels 22 and 24 are assembled. Although not necessary since the preformed foam quarter panels are soft and therefore comfortable, some cushioning or padding may be added between the interior surface 34 of the foam quarter panels and inner lining 26 in the ankle area.

As in traditionally made skate boot, a reinforcement plastic insert (not shown) may be positioned between the foam quarter panels and inner lining 26 in the heel and ankle area of upper 21 in order to provide more support and rigidity in this general area.

Upper eyelets 52 are then punched into the three layers making up the frontal portions 57 of ankle support 25. The three layers consist of narrow band 56, the thin foam peripheral region 36 and inner lining 26. Once punched, the holes are reinforced by metallic rivets or any suitable means as is well known in the art of footwear construction. In the illustrated embodiment of FIG. 9, upper eyelets 52 make up the upper portion of the lacing system of skate boot 20, but could also make up the horizontal edge 37, as we normally see on skate boots. A lace (not shown) first extends through each loop 50 in a criss-crossing path in an alternate pattern and then through each upper eyelet 52 in a similar alternate criss-crossing pattern. When the lace is tightened, the two-quarter panels are caused to come closer together.

A series of lace loops 50, in the form of flexible traction resistant straps, are sewn or otherwise attached to the interior surface of upper horizontal edge 37 of each quarter panels 22 and 24. Lace loops 50 make up the lower portion of the lacing system of skate boot 20. A lace (not shown) extends through each loop 50 in a crisscrossing path in an alternate pattern. When the lace is tightened, the two edges 37 of the quarter panels are caused to come closer together. Loops 50 are preferably sewn to the peripheral thin region 36 of each quarter panel (FIG. 1). As illustrated, the series of lace loops 50 are located inside each quarter. giving skate boot 20 a different look, the lower portion of the lacing system being less visible. It must be noted that lace loops 50 may easily be replaced by standard lace eyelets, which will perform the same function and provide skate boot 20 with a more traditional look.

Figure 9A:
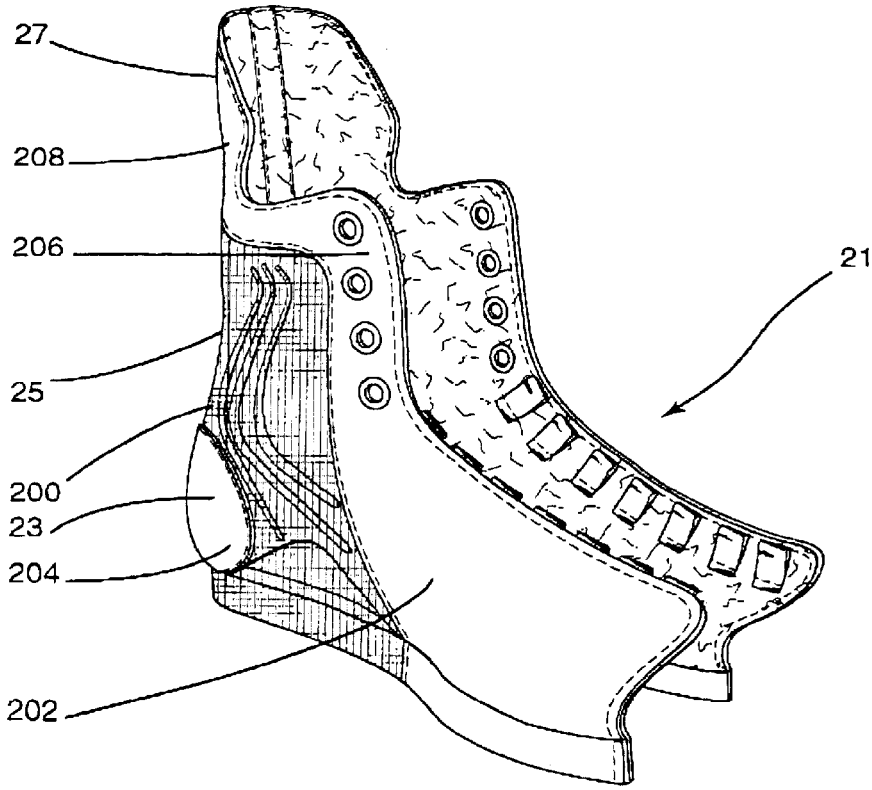
FIG. 9*a* is a perspective view illustrating the upper having a variant of a preformed quarter panel according to a second embodiment of the invention.
Figure 10A:
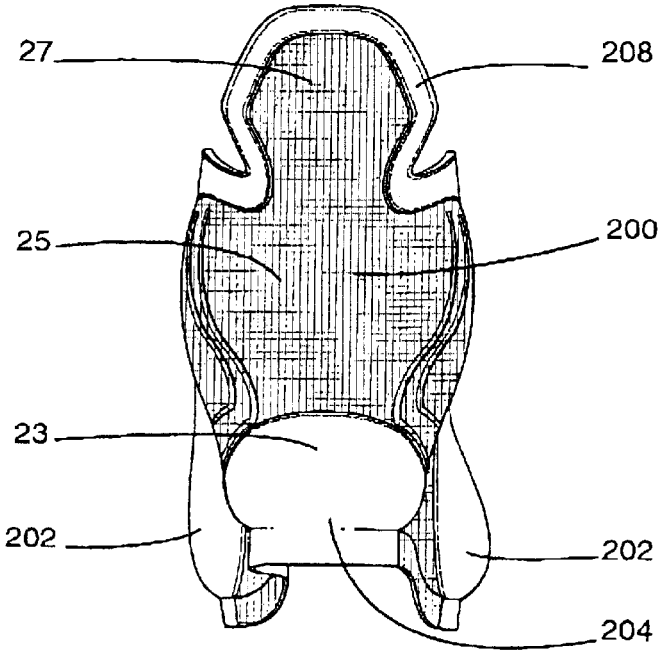
FIG. 10*a* is a rear elevational view of the upper of FIG. 9*a;*

Referring to FIGS. 9*a* and 10*a,* there is shown a first variation of the construction of upper 21. Upper 21 is constructed with a one-piece quarter panel 200, illustrated in hatching lines, enclosing only the rear portion of skate boot 20. This one-piece component panel 200 is designed to enclose a portion or substantial portion of the general area of ankle support 25 or designed to enclose a portion or substantial portion of heel counter 23 or to enclose the entire rear portion of skate boot 20. Panel 200 is made of preformed foam material molded to a definitive shape as described above. Panel 200 is sewn to front portions 202 on each side of upper 21 which are made of conventional material such as leather, vinyl, nylon etc. In the illustrated example, heel reinforcement 204 is sewn to the lower portion of Panel 200. Front portion 202 extends upwardly into a narrow band 206 along the front of ankle support 25 and covers the upper margin 208 of tendon guard 27. Panel 200 provides the necessary support and flexibility to the rear portion of skate boot 20.

Figure 9B:
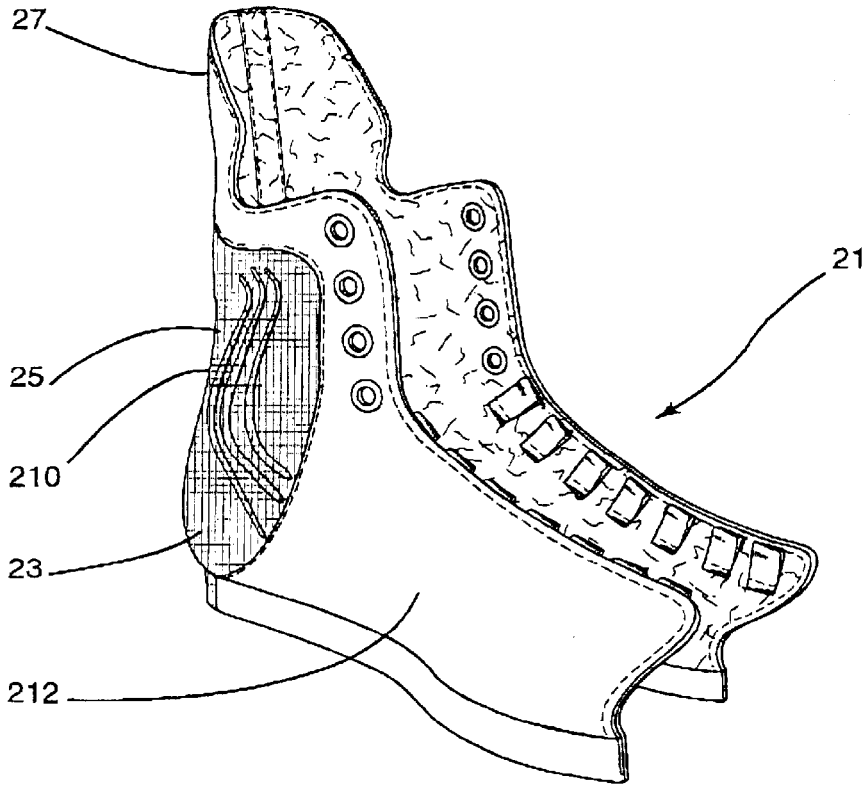
FIG. 9*b* is a perspective view illustrating the upper having a variant of a preformed quarter panel according to a third embodiment of the invention.
Figure 10B:
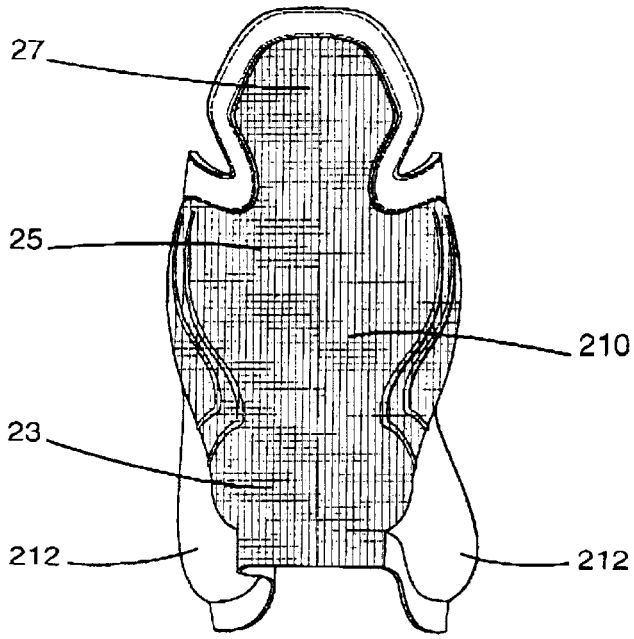
FIG. 10*b* is a rear elevational view of the upper of FIG. 9*b;*

FIGS. 9*b* and 10*b* illustrate a further variation of the rear panel. In the illustrated example, panel 210 encloses and covers the entire rear portion of upper 21 including heel counter 23, ankle support 25 and a portion of tendon guard 27. Panel 210 is sewn to front portions 212 on each side of upper 21 which are made of conventional material and cover a substantial portion of the front of skate boot 20.

Figure 9C:
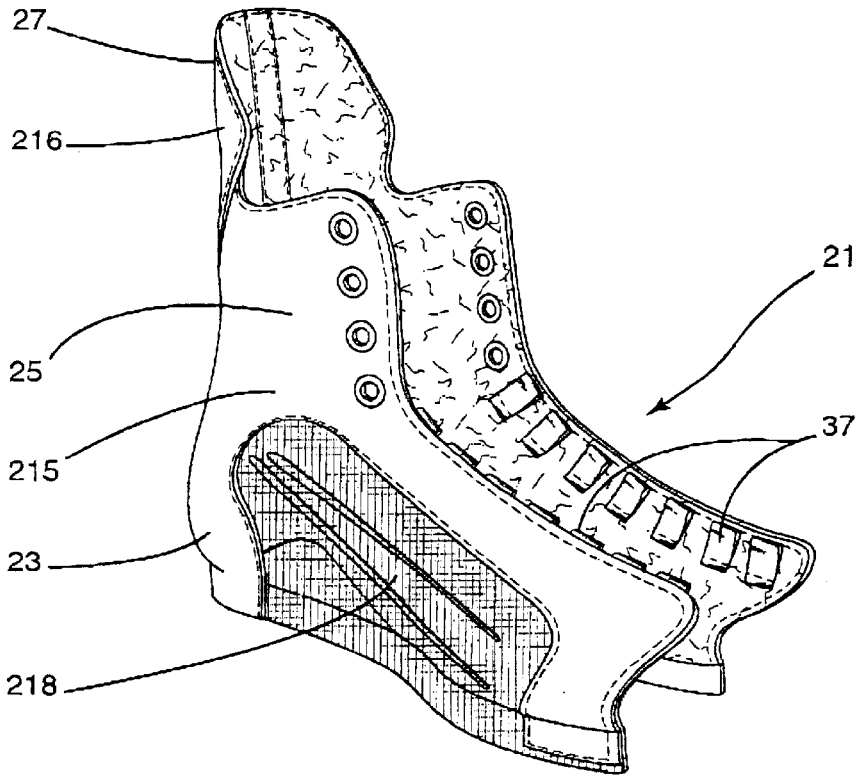
FIG. 9*c* is a perspective view illustrating the upper having a variant of a preformed quarter panel according to a fourth embodiment of the invention.
Figure 10C:
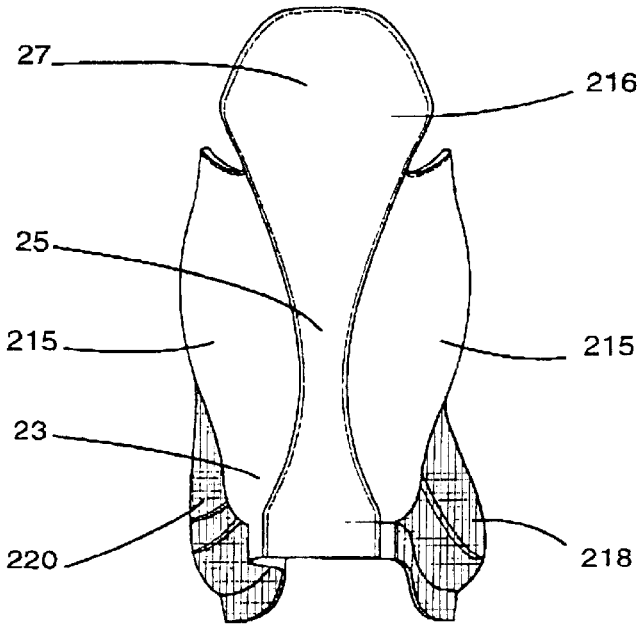
FIG. 10*c* is a rear elevational view of the upper of FIG. 9*c;*

Conversely, as illustrated in FIGS. 9*c* and 10*c,* the rear portion of upper 21 may be made of conventional material while a substantial portion of each side of skate boot 20 is made of preformed molded foam material. The rear portion of upper 21 including heel counter 23, ankle support 25 and tendon guard 27 is made of a first layer 215 of conventional material reinforced with a second layer 216 of conventional material covering tendon guard 27 and extending down to heel counter 23. The first layer 215 extends along the upper edges 37 of each side of upper 21. Preformed molded quarter panels 218 and 220 are sewn into first layer 215 and complete each side of upper 21. Preformed molded quarter panels 218 and 220 provide support and flexibility to the sides of skate boot 20.

As a further variant of skate boot 20, it is possible to use a single preformed molded panel on only one side of the skate boot. This arrangement would provide two different types of support on either side of the skate boot.

Figure 11:
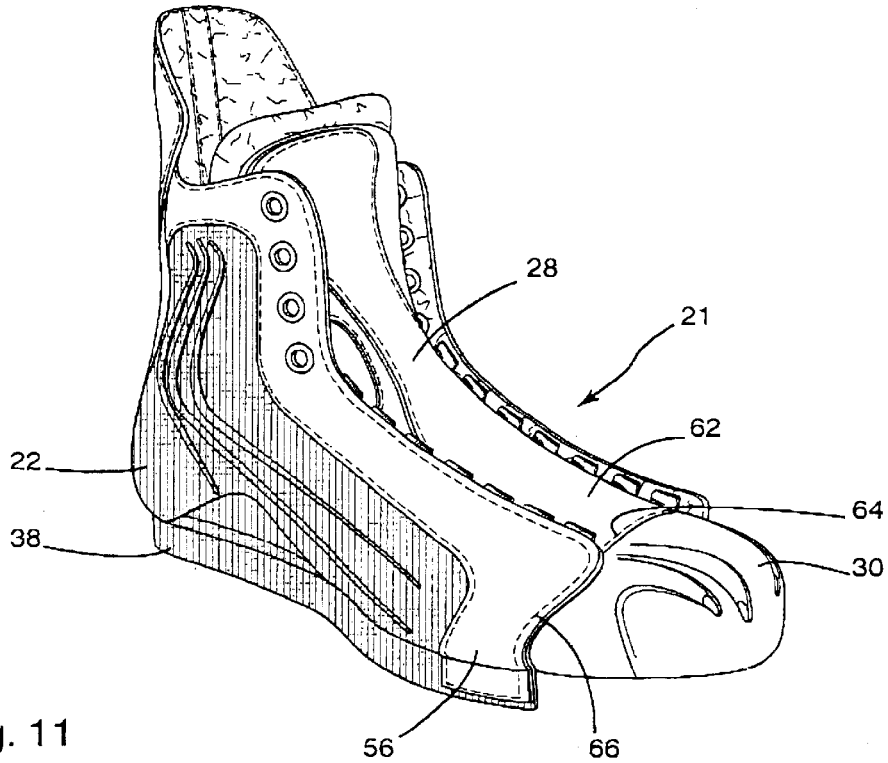
FIG. 11 is a perspective view illustrating the upper with a toe box and tongue installed according to an embodiment of the invention.

Referring to FIG. 11 a tongue 28 and a toe box 30 are added to the construction shown in FIG. 9. Preferably, toe box 30 and tongue 28 are preassembled prior to installing into upper 21. The frontal edge 62 of tongue 28 is sewn directly to toe box 30 at stitching line 64, and then both sides of toe box 30 are sewn to each quarter panels 22 and 24 and to narrow band 56 at stitching line 66. A specific toe box and tongue is shown in this embodiment, however, any type of toe box whether made of a rigid plastic, covered with a textile overlay, or a soft toe box can be used. Similarly, various types of tongue may be used. These are detail variations, which do not effect the general construction of the skate boot as outlined herein.

Figure 12:
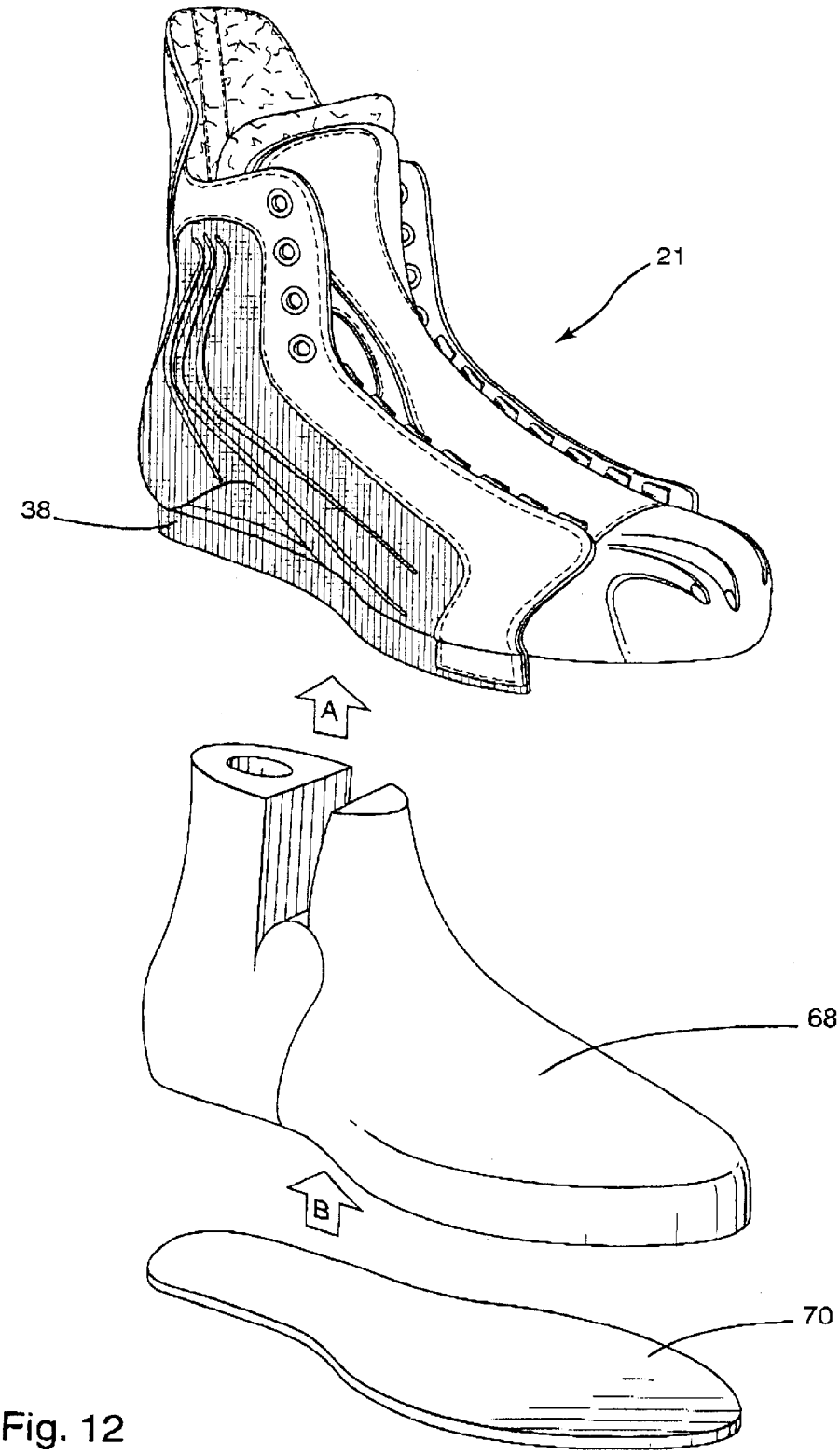
FIG. 12 is a perspective view illustrating the lasting process of folding the lower skirt and positioning the insole according to an embodiment of the invention.

Referring now to FIG. 12, a last 68 is inserted into the inside cavity of upper 21. A last is a three-dimensional shape of the inside cavity of skate boot 20 which enables upper 21 to maintain its shape when skirt 38 is folded to give upper 21 its final shape. Last 68 is inserted into upper 21 and insole 70 is positioned underneath last 68 inside skirts 38 as illustrated by arrows A and B of FIG. 12. Once the assembly is completed, upper 21 is placed upside down into a lasting machine. Glue is first applied to the bottom surface of insole 70 along its periphery. Skirt 38 is then folded over last 68 onto the bottom surface of insole 70, using the lasting machine wipers. Once folded, skirt 38 is adhesively bonded to insole 70 by the glue that was previously laid on the bottom surface of insole 70. Skirt 38 is further nailed or tacked all around insole 70 to provide the necessary mechanical grip to remove the pulling forces and allow the glue to properly set between skirt 38 and insole 70. Once skirt 38 is firmly attached to insole 70 and upper 21 has acquired its final shape, a light sanding of the folded skirt is performed to partially even the lower surface of upper 21 and provide a flat surface on which an outsole can be glued or nailed.

Alternatively, the shaping of upper 21 may be accomplished without the use of a last since the foam quarter panels 22 and 24 are already molded to the desired shape of skate boot 20. Foam quarter panels 22 and 24 may be designed with interlocking means adapted to securely connected each other as well as connected other components such as toe box 30 and tongue 28 to the frontal portion of foam quarter panels 22 and 24.

As illustrated in FIG. 13, a rigid plastic outsole 32 is mounted to the bottom surface of upper 21 with adhesive or nails. Outsole 32 provides a rigid platform to further strengthen upper 21 and provides a solid member onto which a ground engaging means such as an ice blade holder 80 or an in-line roller chassis 82 can be mounted.

Figure 14:
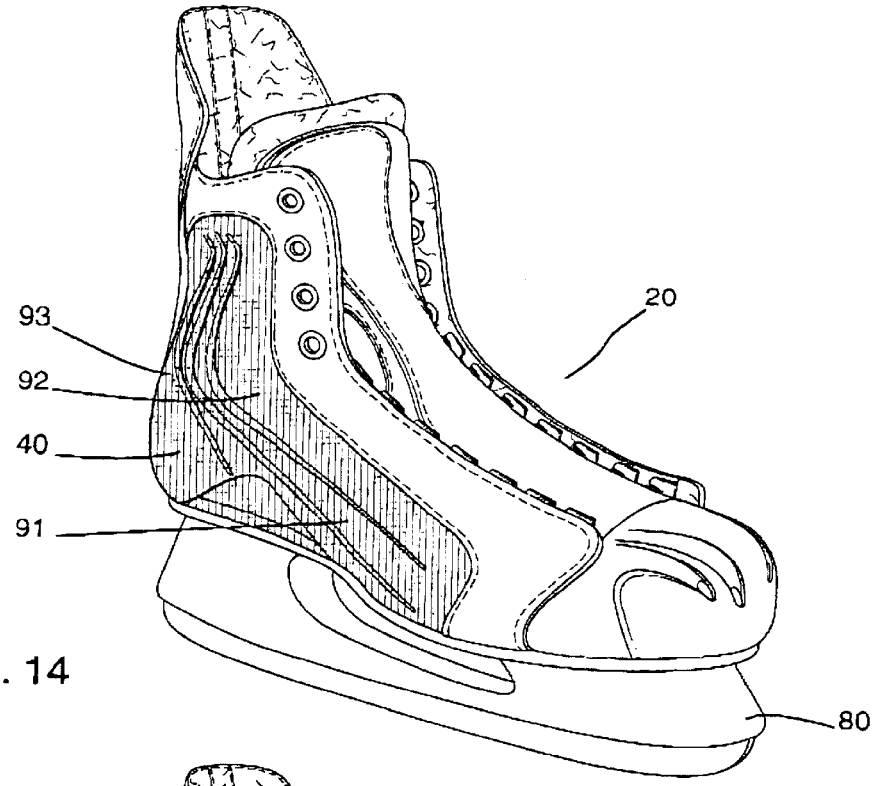
FIG. 14 is a perspective view illustrating an ice skate according to an embodiment of the invention.
Figure 15:
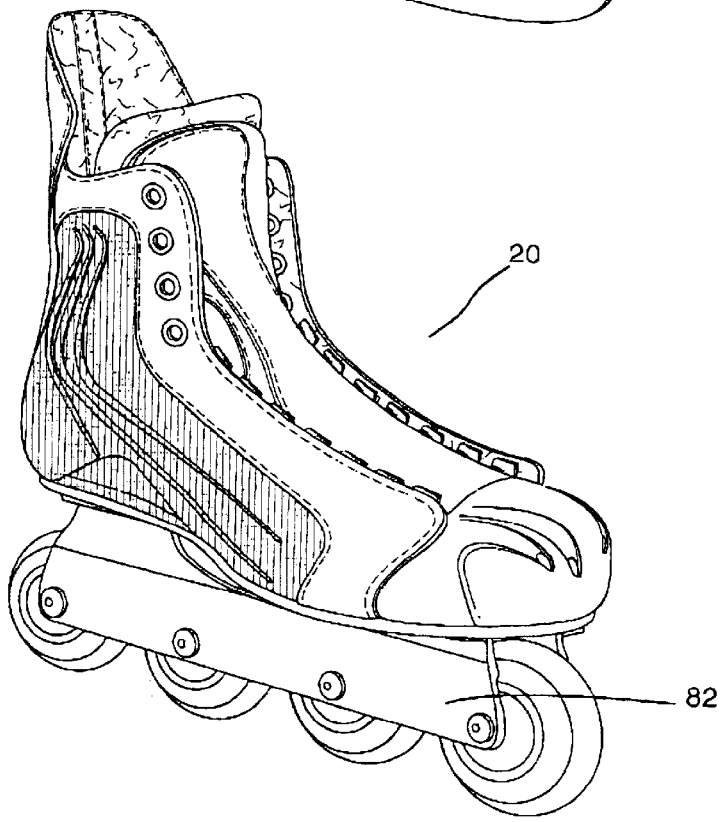
FIG. 15 is a perspective view illustrating an in-line roller skate according to an embodiment of the invention.

As shown in FIGS. 14 and 15, an ice blade holder 80 or an in-line roller chassis 82 may be mounted to skate boot 20. Fasteners such as rivets or screws are typically used to secure the ground engaging means to skate boot 20 although many other methods can be used as is well know in the field of ice skates and especially in-line roller skates.

By using the outlined construction method, substantial cost saving may be expected compared to the traditionally made stitched skate boot. Most of the possible cost saving is realized through the elimination of pattern pieces and various components assembly. Using preformed molded quarter panels made of variable thickness foam material instead of conventional textile and stitched together in a multi-layer construction, results in a substantial reduction of the number of parts to be assembled and therefore of the labor involved. Furthermore, the use of preformed molded quarter panels allows for greater flexibility in design modifications and in performance requirement changes. The thickness, density and design features of the preformed molded quarter panels may be modified while leaving the contours essentialy unchanged so that a new preformed molded quarter panel may be introduced into the production of the skate boot without adding steps of the construction method or additional pieces to the construction. The use of preformed molded quarter panels allows the designers to include ornamental features to the skates without adding pieces as is usually done in traditionally made skates. It is also worth noting that a foam quarter panel may be used to produce two or more skate sizes. For example, the same quarter panel may be used to produce a size 9 or a size 9½; the variation being taken by the adjacent covering pieces such as narrow band 56 and rear covers 60 and 61.

Reference is now made to FIG. 14. In use, preformed molded quarter panels 22 and 24 provide lateral support as well as resistance to forward flexing of skate boot 20. During the power stroke of a skater (skater's ankle flexes forward), a compression of the foam material occurs in the frontal area 91 as well as in the front ankle area 92 of each quarter panel whereas an extension or stretching of the foam material occurs in back portion 93. The resistance to flexing mostly occurs in the thicker central portion 40 of each quarter panels. The inherent elastic behavior of the foam material of the quarter panels provides a springing action or energy return effect to skate boot 20 as the skater completes the power strokes. The elastic property of the foam quarter panels tend to help the skater in the last phase of the power stroke by giving back some of the energy that was used to flex or bend the foam quarter panels at the beginning of the power stroke. The amount of lateral support and resistance to forward flexing as well as springing action of the quarter panels varies depending upon the choice of the foam density. grade, quantity and layers as previously described.

The elastic behavior of the foam material of quarter panels 22 and 24 also prevents the formation of cracks or creases in the front ankle area 92. Traditionally made skate boots eventually develop cracks in this area as the textile material fatigues. Again, since the foam material of quarter panels 22 and 24 behave elastically, skate boot 20 does not fatigue as rapidly as traditionally made skate boots and exhibits a longer life cycle. Finally, the use of preformed foam quarter panels provides a skate boot made up of mostly absorbing material, which adjust itself to minor differences in foot and ankle morphology. This creates a very comfortable skate boot.

The above description of preferred embodiments should not be interpreted in a limiting manner since other variations, modifications and refinements are possible within the spirit and scope of the present invention. The scope of the invention is defined in the appended claims and their equivalents.

The embodiments of the invention for which an exclusive privilege or property is claimed are defined as follows:

1. A lasted skate boot comprising an upper for enclosing and supporting a human foot having a heel, an ankle, a plantar surface, a medial side, a lateral side, an upper frontal portion and toes, said upper comprising an outer shell and an inner lining mounted inside said outer shell wherein:

(a) said inner lining comprises a surface intended for contact with the heel, the ankle and the medial and lateral sides of the foot in use; said inner lining is less rigid than said outer shell;

(b) said outer shell comprises medial and lateral quarters for enclosing the medial and lateral sides of the foot respectively, at least one of said quarters comprises a molded panel made of synthetic material, said molded panel comprising an outer surface and an inner surface, said inner surface being shaped to substantially conform to one of the medial and lateral sides of the foot; and (c) said lasted skate boot further comprises an insole facing the plantar surface of the foot, one of said molded panel and said insole comprising a portion overlapping the other of said molded panel and said insole.

2. A skate boot as defined in claim 1 wherein said molded panel comprises a lower skirt portion that is foldable for overlapping said insole.

3. A skate boot as defined in claim 1 further comprising a toe box for enclosing the toes of the foot and a toe box fastener for affixing said toe box to said outer shell.

4. A skate boot as defined in claim 2 further comprising an insole fastener affixing said insole to said outer shell.

5. A skate boot as defined in claim 1 wherein said medial and lateral quarters comprise respective medial and lateral molded panels affixed together.

6. A skate boot as defined in claim 1 wherein said molded panel has a varying thickness.

7. A skate boot as defined in claim 6 wherein said molded panel comprises a central portion and a peripheral portion, said peripheral portion being thinner than said central portion.

8. A skate boot as defined in claim 5 wherein said outer shell comprises a protective textile overlay made of synthetic material, said overlay covering at least a portion of said medial and lateral molded panels.

9. A skate boot as defined in claim 1 wherein said molded panel is made of thermoformable foam.

10. A skate boot as defined in claim 1 wherein said molded panel is made of layers of different grades of thermoformable foam.

11. A skate boot as defined in claim 3 further comprising a tongue extending upwardly and rearwardly from said toe box.

12. A skate boot as defined in claim 11 further comprising an insole fastener for affixing said insole to said outer shell.

13. A skate boot as defined in claim 1 further comprising lacing engaging members disposed in an upper portion of said medial quarter and said lateral quarter and a rear cover secured to a rear portion of said outer shell.

14. A skate boot as defined in claim 13 wherein said lacing engaging members include lacing loops.

15. A skate boot as defined in claim 13 wherein said lacing engaging members include eyelets.

16. An ice skate comprising the lasted skate boot as defined in claim 1.

17. An in-line roller skate comprising the lasted skate boot as defined in claim 1.

18. A molded panel of synthetic material for use in an outer shell of an upper of a lasted skate boot having a sole component, the upper also having an inner lining mounted inside the outer shell, the inner lining being less rigid than the outer shell, said molded panel having an outer surface and an inner surface, said inner surface being shaped to substantially conform to at least one of the medial and lateral sides of a human foot, said molded panel having a lower skirt portion foldable to overlap the sole component of the lasted skate boot.

19. A lasted skate boot comprising the molded panel as defined in claim 18.

20. An ice skate comprising the lasted skate boot as defined in claim 19.

21. An in-line roller skate comprising the lasted skate boot as defined in claim 19.

22. A lasted skate boot as defined in claim 19 wherein said sole component comprises an insole.

23. A skate boot as defined in claim 4 wherein said insole fastener is selected from the group consisting of stitches, glue, nails, adhesives and tacks.

24. A skate boot as defined in claim 3 wherein said toe box fastener is selected from the group consisting of stitches, glue, nails, adhesives and tacks.

25. A skate boot as defined in claim 9 wherein said molded panel is made of ethylene vinyl acetate (EVA).

26. A skate boot as defined in claim 25 wherein said lower skirt portion extends along a lower edge of said molded panel.

27. A skate boot as defined in claim 26 further comprising an insole fastener affixing said lower skirt portion to said insole.

28. A molded panel as defined in claim 18 wherein said molded panel is made of thermoformable foam.

29. A lasted skate boot comprising an upper for enclosing and supporting a human foot having a heel, an ankle, a plantar surface, a medial side, a lateral side, an upper frontal portion and toes, said upper comprising an outer shell and an inner lining mounted inside said outer shell wherein:

(a) said inner lining comprises a surface intended for contact with the heel, the ankle and the medial and lateral sides of the foot in use; said inner lining is less rigid than said outer shell;

(b) said outer shell comprises medial and lateral quarters for enclosing the medial and lateral sides of the foot respectively, said medial and lateral quarters comprising respective medial and lateral molded panels made of synthetic material, said medial molded panel comprising an inner surface shaped to substantially conform to the medial side of the foot; said lateral molded panel comprising an inner surface shaped to substantially conform to the lateral side of the foot; and (c) said lasted skate boot further comprising an insole facing the plantar surface of the foot, one of said molded panels and said insole comprising a portion overlapping the other of said molded panel and said insole.

30. A skate boot as defined in claim 29 wherein said molded panels are made of thermoformable foam.

31. A skate boot as defined in claim 30 wherein said molded panels are affixed together.

32. A skate boot as defined in claim 30 wherein said molded panels are made of layers of different grades of thermoformable foam.

33. A skate boot as defined in claim 30 wherein said medial and lateral molded panels comprise a lower skirt portion extending along a lower edge of said medial and lateral panels, said lower skirt portion being foldable to overlap said insole.

34. A skate boot as defined in claim 33 further comprising an insole fastener affixing said lower skirt portion to said insole.

35. A skate boot as defined in claim 34 wherein said outer shell comprises a protective overlay covering at least a portion of said medial and lateral molded panels.

36. A skate boot as defined in claim 35 further comprising a toe box for enclosing the toes of the foot and a toe box fastener for affixing said toe box to said outer shell.

37. A skate boot as defined in claim 36 further comprising a tongue extending upwardly and rearwardly from said toe box.

38. A skate boot as defined in claim 37 further comprising lacing engaging members disposed in an upper portion of said medial quarter and said lateral quarter and a rear cover secured to a rear portion of said outer shell.

39. A skate boot as defined in claim 38 wherein said lacing engaging members include lacing loops.

40. A skate boot as defined in claim 38 wherein said lacing engaging members include eyelets.

41. An ice skate comprising the lasted skate boot as defined in claim 30.

42. An in-line roller skate comprising the lasted skate boot as defined in claim 30.

* * * * *

UNITED STATES PATENT AND TRADEMARK OFFICE

CERTIFICATE OF CORRECTION

PATENT NO. : 6,769,203 B1
DATED : August 3, 2004
INVENTOR(S) : Wright et al.

It is certified that error appears in the above-identified patent and that said Letters Patent is hereby corrected as shown below:

Title page,
Item [56], References Cited, U.S. PATENT DOCUMENTS, insert

| | | |
|---|---|---|
| -- 4,509,276 | 04/09/1985 | Bourque |
| 5,785,909 | 07/28/1998 | Chang et al. |
| 6,499,233 | 12/31/2002 | Chenevert |
| 6,558,784 | 05/06/2003 | Norton et al. -- |

FOREIGN PATENT DOCUMENTS, insert

| | | |
|---|---|---|
| -- CA 2,362,758 | 09/08/2000 | Norton et al. |
| GB 1,141,836 | 02/05/1969 | Baudou |
| WO 00/51458 | 09/08/2000 | Norton et al. -- |

Signed and Sealed this

Second Day of November, 2004

JON W. DUDAS
*Director of the United States Patent and Trademark Office*